US007237971B2

(12) United States Patent
Obsorne

(10) Patent No.: US 7,237,971 B2
(45) Date of Patent: Jul. 3, 2007

(54) MARKER PENS

(75) Inventor: Andrew John Obsorne, West Sussex (GB)

(73) Assignee: Jakks Pacific, Inc., Malibu, CA (US)

( * ) Notice: Subject to any disclaimer, the term of this patent is extended or adjusted under 35 U.S.C. 154(b) by 0 days.

(21) Appl. No.: 10/513,619

(22) PCT Filed: May 6, 2003

(86) PCT No.: PCT/GB03/01908

§ 371 (c)(1),
(2), (4) Date: Nov. 4, 2004

(87) PCT Pub. No.: WO03/095230

PCT Pub. Date: Nov. 20, 2003

(65) Prior Publication Data

US 2005/0175391 A1 Aug. 11, 2005

(30) Foreign Application Priority Data

May 7, 2002 (GB) ..... 0210368.7

(51) Int. Cl.
*B43K 27/04* (2006.01)
*B43K 5/00* (2006.01)

(52) U.S. Cl. ..... 401/35; 401/34; 401/198

(58) Field of Classification Search ..... 401/34, 401/35, 198, 199
See application file for complete search history.

(56) References Cited

U.S. PATENT DOCUMENTS 3,887,287 A * 6/1975 Rosh, Jr. ..... 401/35
4,043,682 A * 8/1977 McDaniel et al. ..... 401/199
5,388,924 A * 2/1995 Chao ..... 401/35
6,554,517 B2 * 4/2003 Ahmed ..... 401/35

* cited by examiner

*Primary Examiner*—David J. Walczak
(74) *Attorney, Agent, or Firm*—Richard B. Klar; Law Office of Richard B. Klar

(57) ABSTRACT

A marker pen has a housing at one end of which protrudes a plurality of fluid retaining nibs each shaped to define along an upper surface a ridge. The nibs are positioned side-by-side with adjoining ends of neighbouring ridgees in contact or in close proximity to
define together a continuous (or substantially continuous) ridge. A coating of an impermeable material is applied to one or more of the nibs, or alternatively, one or more outer sheaths of impermeable material may be applied to one or more of the nibs to
prevent or inhibit migration of dye from adjoining nibs.

25 Claims, 2 Drawing Sheets

MARKER PENS

This Invention relates to marker pens.

Typically marker pens comprise a tubular housing having a fibrous felt-like nib connected via a liquid absorbent wick to an internal reservoir containing an indicator such as a water-based ink which contains a coloured dye. As the marker pen is used the fibrous nib is replenished with ink which travels from the reservoir by capillary action to the nib via the wick. Such pens are well known and are used inter alia to mark text and produce coloured effects on paper or similar materials. Known marker pens are generally used to produce a line of a single colour. Marker pens having two or more spaced nibs have been proposed. These produce two or more spaced lines of colour. To produce adjoining lines of different colour two or more pens are generally required, the nibs of the pens being in contact at their neighbouring edges. Such contact will inevitably produce colour migration from one nib to the other.

A drawing pen for drawing lines having different shades is disclosed in U.S. Pat. No. 5,388,924. This pen includes a plurality of ink reservoirs positioned within a barrel and a plurality of absorptive drawing tips respectively connected to the ink reservoirs. The absorptive drawing tips have adjacent surfaces which are complementary and engaged to one another by a watertight bonding agent.

U.S. Pat. No. 3,887,287 discloses a multi-colour marking Implement having a body comprising a tubular container having a plurality of separate elongated internal liquid-tight chambers. Each chamber contains a different colour ink and communicates with one of a plurality of separate nibs each to provide a different marking colour for each nib.

DE-A-3918373 discloses a device capable of producing two different side-by-side or superimposed colours. The device comprises a housing including two containers for ink or paint. A collar fits over the open end of the housing and has two through holes for rods of absorbent material. These rods are enclosed in sleeves and their lower ends fit in the containers whilst their upper ends have tips suitable for writing or painting and are held apart at a defined distance by the holes in the collar.

DE-A-19933182 discloses two pens carrying the two different colours which adjoin one another and dip at the rear into fluids present in a colour-permeated sponge. The pens are separated by an impermeable dividing wall and the tip or endface of the one pen reaches beyond the other.

One object of the present invention is to provide a marker pen capable of producing in one stroke a stripe of two or more colours with no, or very limited, colour migration between neighbouring stripes.

According to the present invention in another aspect, there is provided a marker pen which comprises a housing from one end of which protrudes a plurality of fluid retaining nibs each shaped to define along an upper surface a ridge, the nibs being positioned side-by-side with adjoining ends of neighbouring ridges in contact or in close proximity to define together a continuous (or substantially continuous) ridge and means for preventing or inhibiting migration of dye from adjoining nibs.

Each nib may be replenished by a coloured dye present in a chamber positioned within the housing. A separate chamber may be provided for each nib.

Two, three, or more nibs may be provided. The continuous ridge may, for example, be straight, curvilinear or angled.

The or each nib may be triangular in cross-section with the apex of the triangle defining the nib ridge. In this arrangement, the sides of the nib may each be inclined downwardly from the ridge at the same or approximately the same angle. Alternatively, one nib side may extend generally vertically from the ridge.

In an alternative arrangement, the or each nib comprises a wall whose upper edge defines a ridge, the wall upstanding from a generally horizontal base.

The migration inhibiting means may comprise a coating of an impermeable material applied to one or more sides of one or more nibs. Where three nibs are employed, only the central nib or the outer nibs may be coated. Alternatively, all three nibs may be coated. A suitable coating material comprises an oil-based liquid or a wax. Alternatively, one or more nibs may be sheathed in an impermeable material, for example a plastics such as PVC.

The ridge lengths of neighbouring nibs may be the same or may differ. Preferably, the dyes applied to neighbouring nibs are or different colour.

The nibs are preferably produced from a relatively inflexible and may comprise the material POREX. This is a porous fluid retaining substance which holds its shape when applied to a surface in the manner of a marker to paper, card or like material. Other materials having similar physical properties may, however, be used.

The nibs may be connected to receive fluid from the chambers through wicks. The chambers typically comprise transorbs. A transorb essentially comprises a quantity of fluid retaining fibrous material positioned within an impermeable sheath. The fluid retaining material may be a fibrous material. The sheath is typically open at both ends one of which receives the wick by which fluid present in the transorb is passed by capillary action to the respective nib of a marker pen.

The chambers may be tubular in cross-section with their outer walls lying adjacent to or in contact with the Inner wall of the housing.

The fluids present in the chambers may comprise indicators such as a water-based ink containing coloured dyes, dispersed pigments or other colouring media. Alternatively, the fluids may comprise oil-based coloured dyes.

One or more of the transorbs may be retractably or removably mounted within the housing to vary the length of the continuous ridge or to change the colours to be applied by one or more of the nibs.

In another aspect, the invention provides a marker pen including a plurality of fluid retaining nibs protruding from one end of an elongate housing, a relatively narrow ridge formed across the width of each nib and defining with the ridge or ridges of the other nib or nibs a continuous ridge from which fluid can be transferred to a surface, and impermeable means for preventing or inhibiting migration of fluid from one nib to an adjoining nib.

The invention will now be described, by way of example only, with reference to the accompanying diagrammatic drawings in which.

Figure 1:
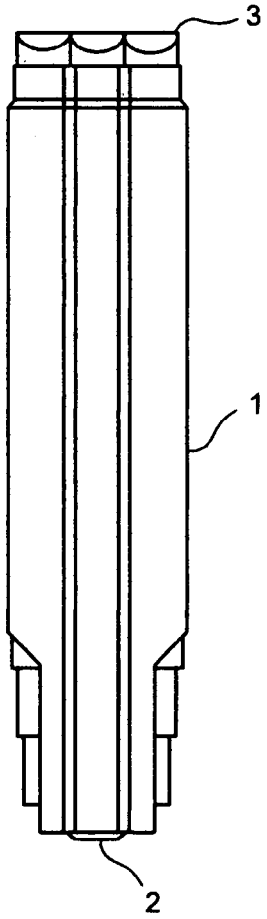
FIG. 1 is a side view of a marker in accordance with the invention.
Figure 2:
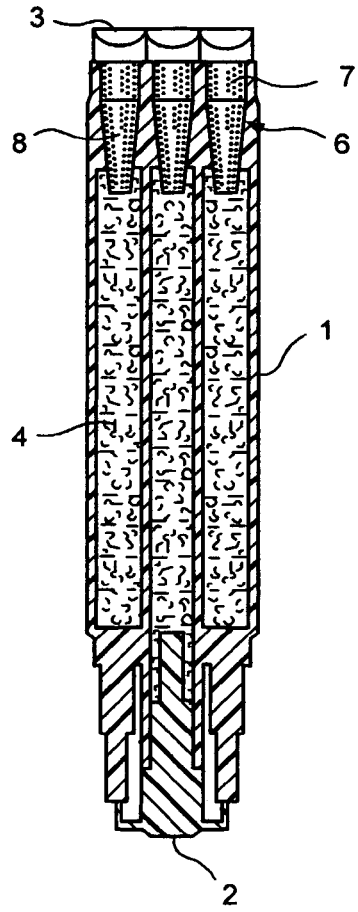
FIG. 2 is a section taken through the marker shown in FIG. 1.
Figure 3:
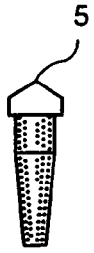
FIGS. 3 and 4 are respectively end and side views of a nib of the maker shown in FIG. 1.

The Illustrated marker pen comprises an elongate hollow outer housing 1 typically produced from a plastics material. Other materials can however be employed. One end of the housing 1 is closed by a bung 2. This end may, however, be permanently sealed. Protruding from the other open end of the housing are three fluid retaining nibs 3.

Positioned within the casing are three elongate transorbs 4 each comprising a mass of fluid retaining fibrous material encased within an impermeable plastics sheath. The sheath material may comprise a sleeve of impermeable material, e.g. PVC. Each transorb 4 may be retained within a separate tubular chamber located within the housing; alternatively the transorbs may be positioned side-by-side within the housing with their impermeable sheaths in contact.

Each nib 3 is produced from a porous material such as that marketed under the trade name POREX. Other materials having the same or similar properties to POREX may be employed. POREX is a mouldable porous material produced by or on behalf of Porex Technologies Corporation. Essentially it comprises a sintered mass of thermoplastic polymer pellets, especially micropellets made by rapid water quenched pelletizing of the polymers. The pellets are generally of a uniform size and shape, each having approximately equal dimensions along three mutually perpendicular axes, have smooth surfaces, narrow pore size distributions, greater strength and other improved characteristics.

Figure 4:
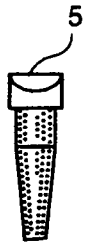
Figure 5:
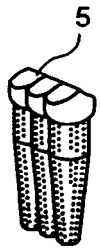
FIGS. 5 and 6 are respectfully perspective and plan views from above of an assembly of three of the marker nibs shown in FIG. 1.
Figure 6:
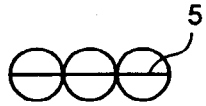
Figure 7:
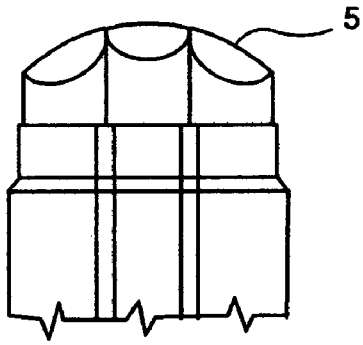
FIG. 7 illustrates the present invention wherein the ridge is curvilinear.
Figure 8:
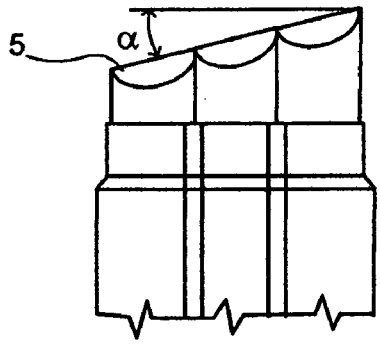
FIG. 8 illustrates the present invention the sides of the nib are each inclined downwardly from the ridge as the same or approximately the same angle.
Figure 9:
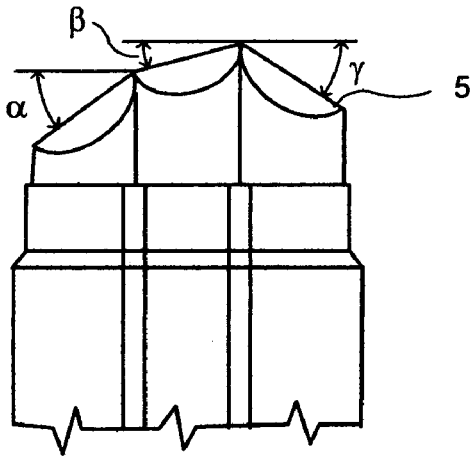
FIG. 9 illustrates the present invention wherein one nib side extends generally vertically from the ridge.
Figure 10:
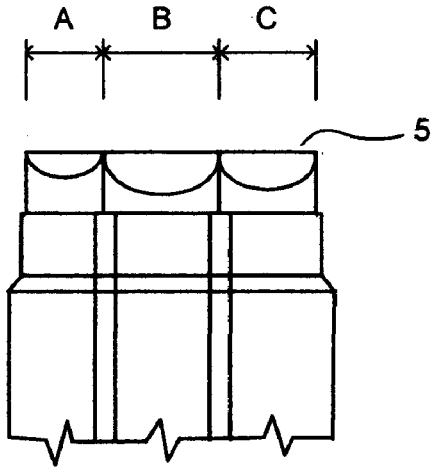
FIG. 10 illustrates the present invention wherein the impermeable material is applied to one or more sides of one or more nibs.

As will be seen from FIG. 4, each nib is of generally triangular shape and includes a ridge 5 positioned at the apex of the triangle. Two inclined surfaces project downwardly from the ridge. Fluid from the respective transorb passes by capillary action to the ridge of each nib through a POREX wick 6. As will be seen from FIGS. 1, 2, 5 and 6 the nibs are positioned side-by-side with the ridge edges of neighbouring nibs in contact. The individual nibs thereby together define a single continuous ridge from which ink of, say, three different colours can be applied to a surface as a single line with one stroke of the marker pen. The width of the line produced will vary depending on the angle at which the nibs are presented to the surface.

The side surfaces of each nib are coated with an impermeable material (eg an oil based liquid or a wax) to prevent colour migration at the contacting edges of neighbouring nibs. Alternatively, each nib may include an outer sheath of impermeable material. The impermeable material prevents, or at least minimises, migration of coloured indicator from one nib to an adjoining nib or nibs.

As will be seen from the drawings, that part of each POREX nib which acts as a wick has an upper collar portion 7 of generally constant diameter or thickness, and a tapering shank 8. Typically, the nib diameter (and therefore the ridge length) is of the order of 8.1 mm and the collar diameter 6 mm. The length of the collar is typically 5 mm and the length of the shank is typically 14 mm. The diameter of the end of the shank is typically 4 mm.

One or more of the transorbs and contacting nibs may be retractable, removable or replaceable either to vary the number of nibs which are used simultaneously at any given time to change or the colours which can be applied to a surface by the marker pen.

As shown, the marker pen has three protruding nibs. Two or more than three nibs may be provided. Also, the length of the ridges 5 may vary; thus, the length of the outermost ridges of a pen having, for example, five nibs may be less than that of the central three pens to provide narrow and possibly darker margins for the multi-coloured line produced by the marker pen.

It will be appreciated that the foregoing is purely exemplary of marker pens in accordance with the Invention and that modifications can readily be made without departing from the three scope of the invention as set out in the appended claims.

The invention claimed is:

1. A marker pen which comprises a housing from one end of which protrudes a plurality of fluid retaining nibs each shaped to define along an upper surface a ridge, the nibs being positioned side-by-side with adjoining ends of neighbouring ridges in contact or in close proximity to define together a continuous or substantially continuous ridge and means for preventing or inhibiting migration of dye from adjoining nibs, each of said nibs has surfaces wherein said migration inhibiting means comprises a coating on said surfaces of at least one or more of said nibs to encase said surfaces of said at least one of said nibs.

2. A pen as claimed in claim 1 wherein each nib may be replenished by a coloured dye present in a chamber positioned within the housing.

3. A pen as claimed in claim 2 wherein the chambers comprise transorbs.

4. A pen as claimed in claim 2 wherein the chambers are tubular in cross-section with their outer walls lying adjacent to or in contact with the inner wall of the housing. a coloured dye present in a chamber positioned within the housing.

5. A pen as claimed in claim 2 wherein fluids present in the chambers comprise indicators such as a water-based ink containing colored dyes, dispersed pigments or other coloring media.

6. A pen as claimed in claim 2 wherein a separate chamber may be provided for each nib.

7. A pen as claimed in claim 1 wherein the ridge is straight.

8. A pen as claimed in claim 1 wherein the ridge is curvilinear.

9. A pen as claimed in claim 1 wherein the ridge is angled.

10. A pen as claimed in claim 1 wherein each nib is triangular in cross-section with the apex of the triangle defining a nib edge.

11. A pen as claimed in claim 10 wherein the sides of the nib are each inclined downwardly from the ridge at the same or approximately the same angle.

12. A pen as claimed in claim 1 wherein one nib side extends generally vertically from the ridge.

13. A pen as claimed in claim 1 wherein the coating of the impermeable material is applied to one or more sides of at least one or more nibs.

14. A pen as claimed in claim 13 in which, where three nibs are employed, only the central nib or the outer nibs are coated.

15. A pen as claimed in claim 13 wherein a suitable coating material comprises an oil-based liquid or wax.

16. A pen as claimed in claim 1 wherein one or more nibs is sheathed in the coating material.

17. A pen as claimed in claim 16 wherein said coating material is an impermeable material.

18. A pen as claimed in claim 1 wherein ridge lengths of neighbouring nibs are the same.

19. A pen as claimed in claim 1 wherein the ridge lengths of neighbouring nibs differ.

20. A pen as claimed in claim 1 wherein the dyes applied to neighbouring nibs are of different colour.

21. A pen as claimed in claim 1 wherein the nibs are produced from a relatively inflexible material.

22. A pen as claimed in claim 1 wherein the nibs are connected to receive fluid from chambers through wicks positioned within the housing.

23. A marker pen including a plurality of fluid retaining nibs protruding from one end of an elongate housing, a relatively narrow ridge formed across the width of each nib and defining with the ridge or ridges of the other nib or nibs a continuous ridge from which fluid can be transferred to a surface, each of said nibs has surfaces, and impermeable means for preventing or inhibiting migration of fluid from one nib to an adjoining nib wherein said impermeable inhibiting means comprises a coating on said surfaces of at least one or more of said nibs to encase said surfaces of said at least one or more of said nibs.

24. A pen as claimed in claim 23 wherein one or more nibs is sheathed in the coating material.

25. A pen as claimed in claim 24 wherein said coating material is an impermeable material.

* * * * *